US006909418B2

(12) United States Patent
Arai

(10) Patent No.: US 6,909,418 B2
(45) Date of Patent: Jun. 21, 2005

(54) IMAGE DISPLAY APPARATUS

(75) Inventor: Nobuhiro Arai, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 422 days.

(21) Appl. No.: 10/119,024

(22) Filed: Apr. 10, 2002

(65) Prior Publication Data

US 2002/0145586 A1 Oct. 10, 2002

(30) Foreign Application Priority Data

Apr. 10, 2001 (JP) ..... 2001-110814

(51) Int. Cl.[7] ..... G09G 3/36
(52) U.S. Cl. ..... 345/98; 345/100; 345/209
(58) Field of Search ..... 345/96, 98–100, 345/209, 213

(56) References Cited

U.S. PATENT DOCUMENTS 6,437,766 B1 * 8/2002 Matsushima et al. ..... 345/98
6,525,720 B1 * 2/2003 Baek ..... 345/213
6,683,596 B2 * 1/2004 Ozawa ..... 345/100

FOREIGN PATENT DOCUMENTS

| | | |
|---|---|---|
| JP | 08-008991 | 1/1996 |
| JP | 10-096888 | 4/1998 |
| JP | 10-149142 | 8/1998 |

* cited by examiner

*Primary Examiner*—Alexander Eisen
*Assistant Examiner*—Robin Mak
(74) *Attorney, Agent, or Firm*—Young & Thompson

(57) ABSTRACT

A shift register outputs at a terminal C1 to a data register a timing pulse which is active only for one clock in synchronization to the first rise of a clock CLK after a shift signal STH is received as a start pulse, and thereafter outputs timing pulses at terminals C2 through C64 one after another to the data register. Further, a logical multiplication gate AND2 yields the logical multiplication of a Q-output of an SR-type flip flop SRFF3 and a superimposed signal, whereby an inversion signal intPOL2 is generated. This inversion signal is outputted to the data register. As an OR gate OR1 yields the logical addition of an output of a logical multiplication gate AND3 and a Q-output of a D-type flip flop DFF64, which causes rising of a superimposed signal of an inversion signal POL2 and the shift signal STH which is shifted to a subsequent-stage source driver.

20 Claims, 12 Drawing Sheets

IMAGE DISPLAY APPARATUS

BACKGROUND OF THE INVENTION

1. Technical Field of the Invention

The present invention relates to an image display apparatus which is suitable for a flat display apparatus such as a liquid crystal display apparatus, and more particularly, relates to an image display apparatus which reduces the number of signal lines.

2. Description of the Related Art

As a liquid crystal display apparatus (LCD) is customarily demanded to use an increased number of pixels and accordingly realize high-speed driving, a plurality of data buses are used to meet this demand.

FIG. 1 is a schematic diagram showing an overall structure of a conventional liquid crystal display apparatus, FIG. 2 is a block diagram showing a relationship between source drivers and a timing controller and the like in the conventional liquid crystal display apparatus, FIG. 3 is a schematic diagram showing a relationship between data buses and data lines, FIG. 4 is a block diagram of a conventional source driver, FIG. 5 is a circuitry diagram of a conventional shift register, and FIG. 6 is a block diagram showing a relationship between a conventional data register and a timing controller.

As shown in FIG. 1, in the liquid crystal display apparatus, n pieces of tape carrier packages (TCP) 102 are connected to source lines (not shown) which run in the vertical direction in a liquid crystal panel 101 and m pieces of TCPs 103 are connected to gate lines (not shown) which run in the horizontal direction in the liquid crystal panel 101. The liquid crystal panel 101 is obtained by sealing up liquid crystals between glass substrates for instance and incorporating a thin film transistor (TFT) and the like. The TCPs 102 each seat one of source drivers 104-1 through **104-*n*, while the TCPs 103 each seat one of gate drivers 105-1 through 105-*m*. Each TCP 102 is connected to a signal processing substrate 107 which mounts a timing controller 106, and each TCP 103 is connected to a vertical-side connection substrate 108. The signal processing substrate 107 and the vertical-side connection substrate 108 are formed by printed circuit boards, for example. An interface connector 109 and a flexible printed circuit board (FPC) 110 are disposed to the signal processing substrate 107. Connected to the interface connector 109 are a display cable (not shown) to which pixel data and the like are transferred, etc. The signal processing substrate 107 and the vertical side connection substrate 108 are bent toward the back side of the liquid crystal panel 101 utilizing the flexibility of the TCPs 102 and 103 respectively, which connects the FPC 110 to the vertical-side connection substrate 108**.

As shown in FIG. 2, a video signal outputted from the interface connector 109 is supplied to the respective source drivers 104-1 through **104-*n* from the timing controller 106 through a data bus group 111. The data bus group 111 is comprised of two data buses for instance. Further, each data bus is formed by six data lines each for red, green and blue, i.e., eighteen data lines as shown in FIG. 3 in the event that pixel data are a 6-bit signal. Hence, where the data bus group 111 is comprised of two data buses for instance, there are thirty-six data lines between the timing controller 106 and each source driver. In the event that pixel data are an 8-bit signal, the data buses are each formed by twenty-four data lines. A clock signal line 112, an inversion signal line 113 and a data latch signal line 114 are connected between the timing controller 106 and each source driver, a clock signal CLK is supplied to each source driver on the clock signal line 112, an inversion signal POL2 is supplied to each source driver on the inversion signal line 113, and a data latch signal STB is supplied to each source driver on the data latch signal line 114. Further, a shift signal line 115 is connected between the timing controller 106 and only the source driver 104-1, and a cascade signal line 116 is connected between the adjacent source drivers. A shift signal STH is supplied to the source driver 104-1 on the shift signal line 115**, whereby this shift signal STH is shifted as a cascade signal across the source drivers one after another.

In addition, a gradation level power source 117 which supplies a gradation level voltage to each source driver is disposed in the liquid crystal display apparatus.

In the event that pixel data are a 6-bit signal, a 64-bit bi-directional shift register 121, a data register 122, a latch circuit 123, a level shifter 124, a digital/analog (D/A) converter 125 and an output buffer 126 are disposed in a conventional source driver as shown in FIG. 4.

A signal R/L which determines the direction in which the shift signal STH is shifted is supplied to the shift register 121. The logic of this signal R/L decides which one of a terminal STHR and a terminal STHL will serve as an input terminal or an output terminal for the shift signal. The shift register 121 also receives the clock signal CLK which determines the timing at which pixel data are loaded and the data latch signal STB which resets an internal flip-flop of the shift register 121 after being outputted from the timing controller 106 at the timing for loading data which are equivalent to one line.

As shown in FIG. 5, sixty-four D-type flip flops DFF101 through DFF164 which are directly connected with each other are disposed in the shift register 121. The clock signal CLK is supplied to a CK-terminal for each one of the D-type flip flops DFF101 through DFF164. In the case that the terminal STHR is to serve as the input terminal for the shift signal STH, an output signal from a logical multiplication gate AND101 is fed to a D-terminal of the first-stage D-type flip flop DFF101. Meanwhile, a QB-terminal of each one of the D-type flip flops DFF101 through DFF164 and the terminal STHR are connected to an input terminal of the logical multiplication gate AND101. As described herein, the "QB-terminal" refers to a terminal which is usually denoted as the letter "Q" directly under the bar (–) sign, and is denoted at the letter "Q" right under the bar (–) sign in the drawings as is normally denoted.

In the shift register 121 having such a structure, output signals from the respective Q-terminals of the D-type flip flops DFF101 through DFF164 become output signals C1 through C64.

The data register 122 receives pixel data of (six bits)×(three colors)×(two data buses), i.e., sixty-four bits in total which are D00 through D05, D10 through D15, D20 through D25, D30 through D35, D40 through D45 and D50 through D55. Further, the data register 122 receives inversion signals POL21 and POL22 which are assigned as the inversion signal POL2 respectively to the two data buses.

As shown in FIG. 6, there are an inversion/non-inversion circuit 131 which receives the pixel data outputted from the timing controller 106 via the data bus group 111 and a register 132 which stores output data from the inversion/non-inversion circuit 131. The inversion signal POL2 as well is supplied to the inversion/non-inversion circuit 131, and when the inversion signal POL2 is active, the pixel data supplied to the inversion/non-inversion circuit 131 are inverted and outputted to a register 132. On the other hand, when the inversion signal POL2 is not active, the pixel data supplied to the inversion/non-inversion circuit 131 are outputted as they are to the register 132. The timing controller 106 comprises a bit comparator 133 which compares data to be transmitted from now and data which were transmitted immediately previously, and an inversion/non-inversion circuit 134 which inverts pixel data in accordance with an output signal from the bit comparator 133 and outputs the pixel data.

In the conventional liquid crystal display apparatus having such a structure, the bit comparator 133 disposed within the timing controller 106 detects how many bits of change has been created between the pixel data to be transmitted from now and the pixel data which were transmitted right before this pixel data, and in the event that half or more of the pixel data has changed, the inversion/non-inversion circuit 134 is provided with a signal which requires the inversion/non-inversion circuit 134 to invert and output the pixel data. Receiving this signal, the inversion/non-inversion circuit 134 inverts the pixel data and outputs the pixel data via the data bus group 111 while outputting the active inversion signal POL2 to the inversion/non-inversion circuit 131 on the inversion signal line 113.

FIG. 7 is a timing chart showing an operation of the conventional shift register 121. As the shift signal STH is received at the terminal STHR, the shift register 121 outputs at the terminals C1 through C64 timing pulses which are for loading the pixel data into the data register 122 in synchronization to rises of the clock signal CLK starting at the next rise of the clock signal CLK. Concurrently with outputting of the timing pulse at the terminal C64, the shift signal STH is outputted at the terminal STHL to the next-stage source driver. In the liquid crystal display apparatus shown in FIG. 5, the shift signal STH from the timing controller 106 is supplied as a start pulse to the shift register 121 of only the source driver 104-1, and the shift registers 121 of the other source drivers are provided with the shift signal STH which is shifted on the cascade signal line 116 from the preceding-stage source driver.

In synchronization to the timing pulse from the shift register 121, the data register 122 stores the pixel data D00 through D05, D10 through D15, D20 through D25, D30 through D35, D40 through D45 and D50 through D55 in the register 132. However, when the inversion signal POL21 or POL22 is active, the inversion/non-inversion circuit 131 inverts the pixel data which were received on one of the two data buses forming the data bus group 111 which corresponds to the active inversion signal, and stores the pixel data in the register 132. Since this method reduces the amount of changes in the digital signals which are transmitted on the data buses, electromagnetic interference (EMI) is reduced and electric power used for charging and discharging of the data buses is decreased. The data register 122 stores signals amounting to 384 bits, i.e., (sixty-four bits)×(two data buses)×(three colors).

In order to output the gradation level voltages to all source drivers 104-1 through **104-*n* at the same time, the latch circuit 123 holds data which are equivalent to one line until outputting of the same. A polarity inversion signal POL for inverting the polarity of a signal for every frame for the purpose of a.c. driving of the liquid crystal panel is supplied to the latch circuit 123 and the output buffer 126**.

Following this, the level shifter 124 converts the logic level of the pixel data, and the D/A converter 125 receiving the gradation level voltages V0 through V9 converts the digital signals into analog signals. Tone level voltages (analog) are then applied to the source lines for the liquid crystal panel 101 from terminals S1 through S384 which are disposed to the output buffer 126.

In the liquid crystal panel 101, the gate lines are scanned over line by line owing to the gate drivers 105-1 through **105-*m*, and in synchronization to the timing of the scanning, the gradation level voltages are applied to the source lines simultaneously from the respective source drivers 104-1 through 104-*n***, whereby displaying is realized at the respective pixels on the voltage-applied source lines.

The liquid crystal display apparatus may be a liquid crystal display apparatus in which there is only one data bus disposed and pixel data are stored in a data register in synchronization to a rise in a clock signal (FIG. 8A), a liquid crystal display apparatus in which there are two data buses disposed and pixel data are stored from both data buses into a data register in synchronization to rising of a clock signal (FIG. 8B), a liquid crystal display apparatus in which there are two data buses disposed and pixel data are stored from each data bus into a data register in synchronization to rising/falling of a clock signal (FIG. 8C), etc.

Japanese Unexamined Patent Publication No. 8-8991 of 1996 describes, in relation to transfer of data in an image display apparatus or the like, a data transfer apparatus which reduces the frequency of switching or the like to thereby reduce consumption current. Disclosed in this publication are a data transfer apparatus in which a clock signal is masked in the absence of a change in data for instance and a data transfer apparatus in which data are transmitted after being inverted in the event of a change in a majority of bits. In a data transfer apparatus in which data are inverted and transmitted in the event of a change in a majority of bits, a 1-bit signal similar to the inversion signal POL2 used in the conventional liquid crystal display apparatus shown in FIG. 8 is generated within a controller and transmitted together with data to a receiving apparatus. This 1-bit signal as well is transmitted on a dedicated signal line. Use of these data transfer apparatuses makes it possible to reduce consumption current.

However, the conventional liquid crystal display apparatus is demanded, because of an improvement in resolution, a higher frequency of the clock signal and an enhancement in transfer speed of pixel data, and therefore, uses more than one data bus as described above. For this reason, it is necessary to use an accordingly increased number of inversion signal lines, and hence, dispose a greater number of pins in LSIs (large-size integrated circuits) which form the timing controller and the source drivers. This leads to a problem in that the size of an LSI package becomes large. In addition, the gaps between the signal lines become narrower as more signal lines are used, which in turn intensifies the influence by mutual inductance and capacitance. Hence, the possibility of malfunction due to cross talk (deterioration in waveform quality) rises. Further, the number of steps for design of a substrate pattern increases in accordance with the increase in the number of signal lines.

These problems are inherent to the data transfer apparatuses which are described in Japanese Unexamined Patent Publication No. 8-8991 of 1996 which aim at a reduction in consumption current or the like. As the number of data buses increases in accordance with an increase in transfer speed, it is necessary to accordingly increase the number of signal lines.

SUMMARY OF THE INVENTION

An object of the present invention is to provide an image display apparatus which is capable of suppressing an increase in the number of signal lines in accordance with an increase in speed of transferring pixel data.

An image display apparatus according to the present invention comprises: a display panel; a plurality of drive circuits which drive the display panel and are connected to each other; and a timing controller which transmits a video signal as a digital signal to the plurality of drive circuits while transmitting a start pulse instructing to start reading the video signal to one of the plurality of drive circuits. In the image display apparatus, when the amount of digital signal change between two continuous video signals reaches or exceeds a predetermined value, the timing controller inverts one to be transmitted later among the two continuous video signals and transmits this video signal to the drive circuits, and an inversion signal which is indicative of the inversion of this video signal is transmitted to the drive circuits. The feature of the image display apparatus is that the start pulse is transmitted to the one drive circuit via a signal line on which the inversion signal is transmitted.

According to the present invention, since the start pulse and the inversion signal are transmitted on the same signal line to the drive circuit which is connected to one end, even where there are a plurality of data buses to which a video signal is transmitted, an increase in the number of signal lines is small.

It is preferable that the drive circuits comprise a data register which stores the video signal and a shift register which is instructed as to the timing of storing the video signal, and the shift register comprises separation means which separates the start pulse from the inversion signal, and the data register can invert the video signal transmitted from the timing controller and store this video signal when the inversion signal separated by the separation means is active.

Further, it is possible to sequentially shift the start pulse among the plurality of drive circuits.

Still further, where the video signal is transmitted to the plurality of drive circuits through two data buses and the inversion signal is generated for each data bus, both inversion signals are transmitted on the same signal line. This allows to transmit the start pulse and the two inversion signals on one signal line.

A liquid crystal display panel for example may be used as the display panel.

DETAILED DESCRIPTION OF THE PREFERRED EMBODIMENTS

Figure 9:
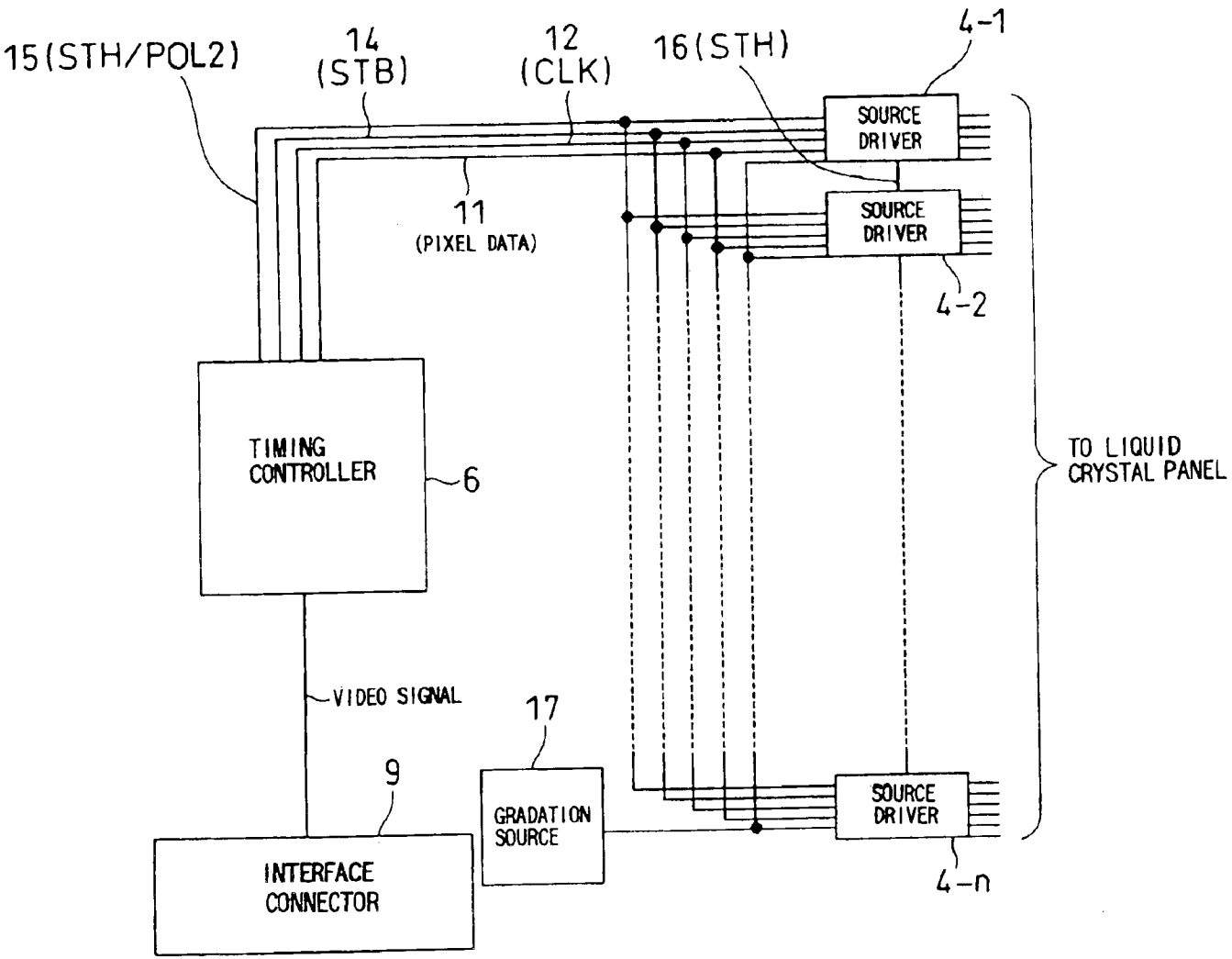
FIG. 9 is a block diagram showing a relationship between source drivers and a timing controller and the like in a liquid crystal display apparatus according to an embodiment of the present invention.
Figure 10:
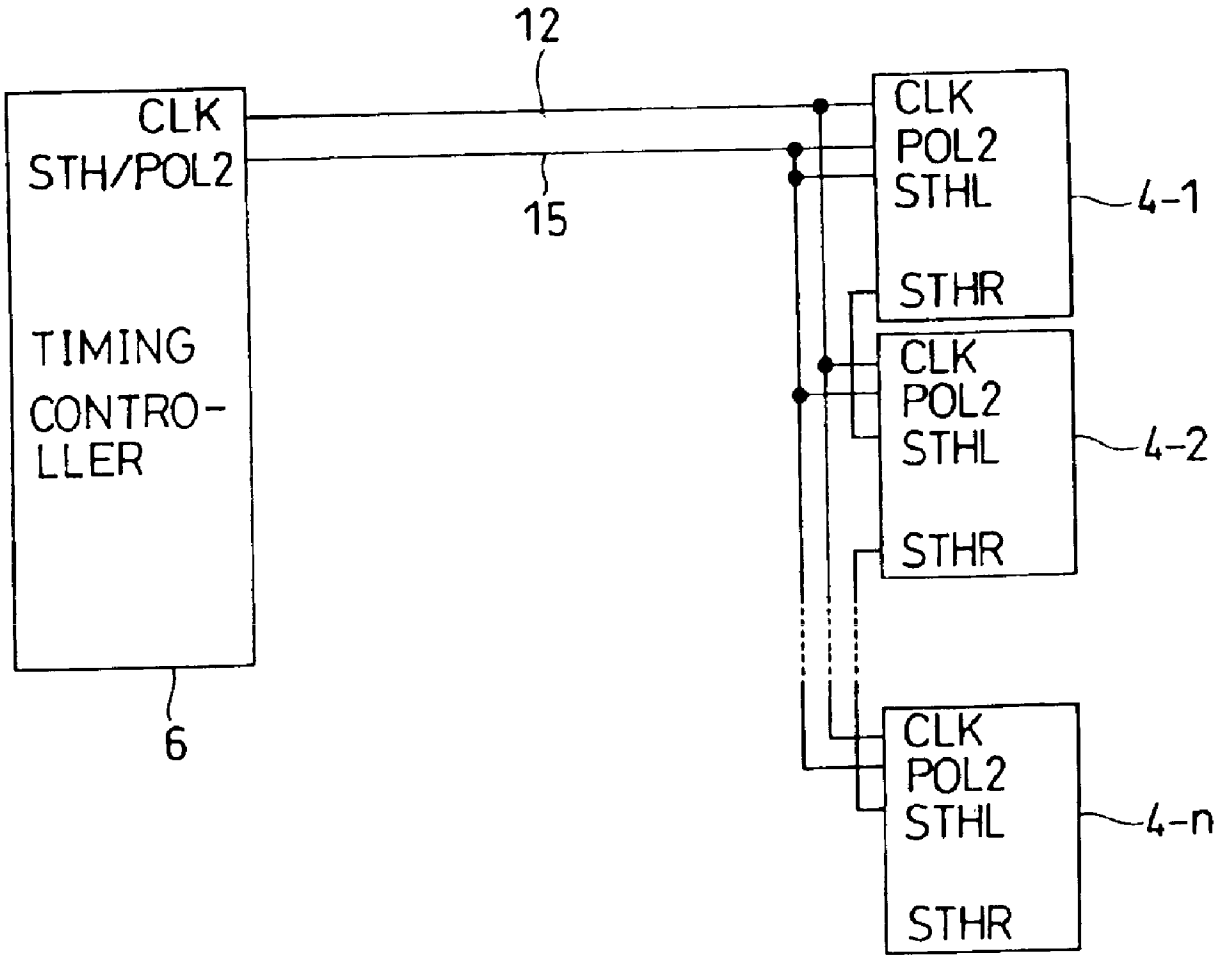
FIG. 10 is a block diagram showing in detail a relationship of how the source drivers and the timing controller are connected in the embodiment of the present invention.
Figure 11:
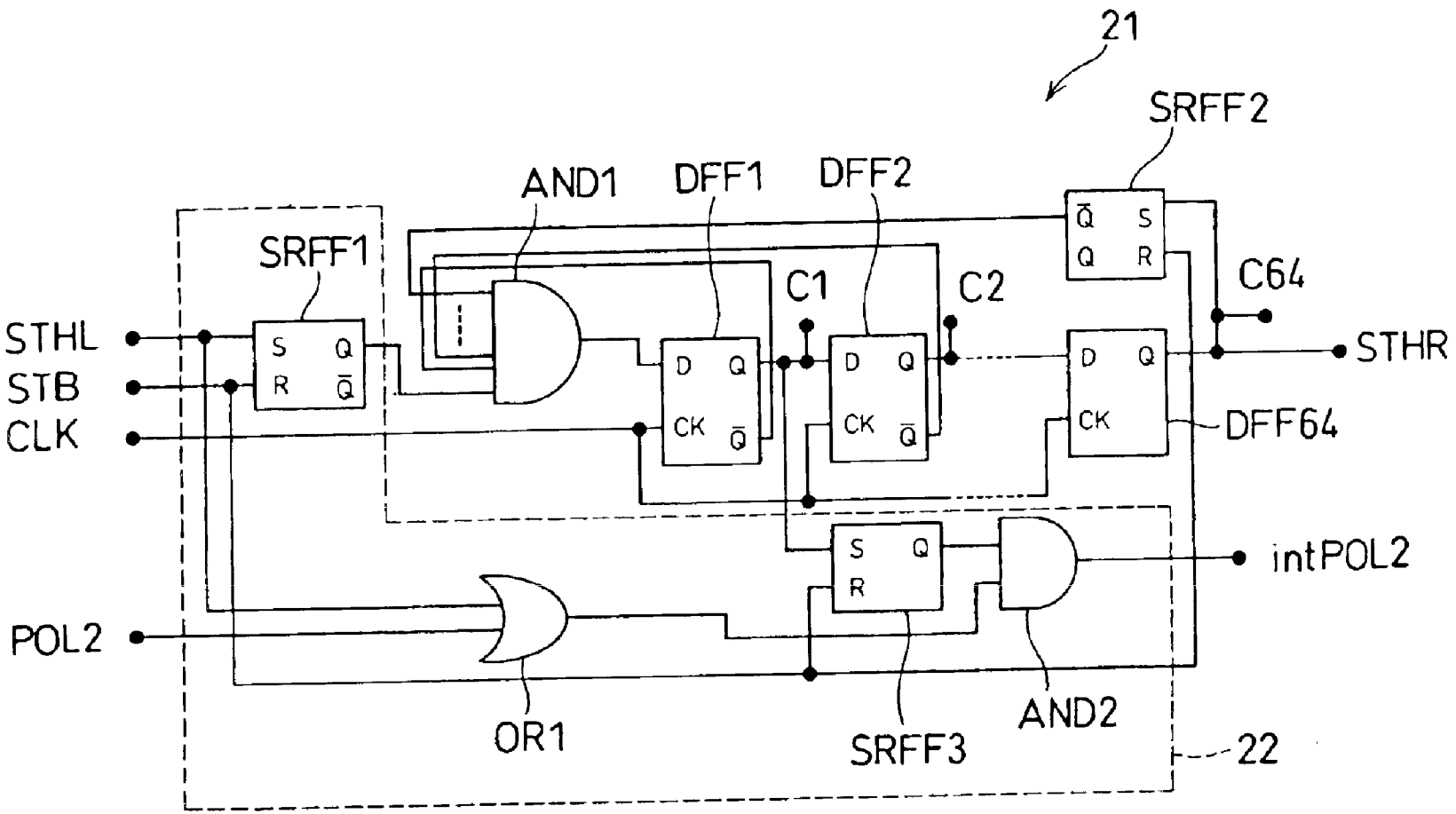
FIG. 11 is a block diagram showing a structure of a shift register in the embodiment of the present invention.

A liquid crystal display apparatus according to embodiments of the present invention will now be described with reference to the associated drawings. FIG. 9 is a block diagram showing a relationship between source drivers and a timing controller and the like in a liquid crystal display apparatus according to the embodiment of the present invention, FIG. 10 is a block diagram showing in detail a relationship of how the source drivers and the timing controller are connected in the embodiment of the present invention, and FIG. 11 is a block diagram showing a structure of a shift register in the embodiment of the present invention.

Figure 1:
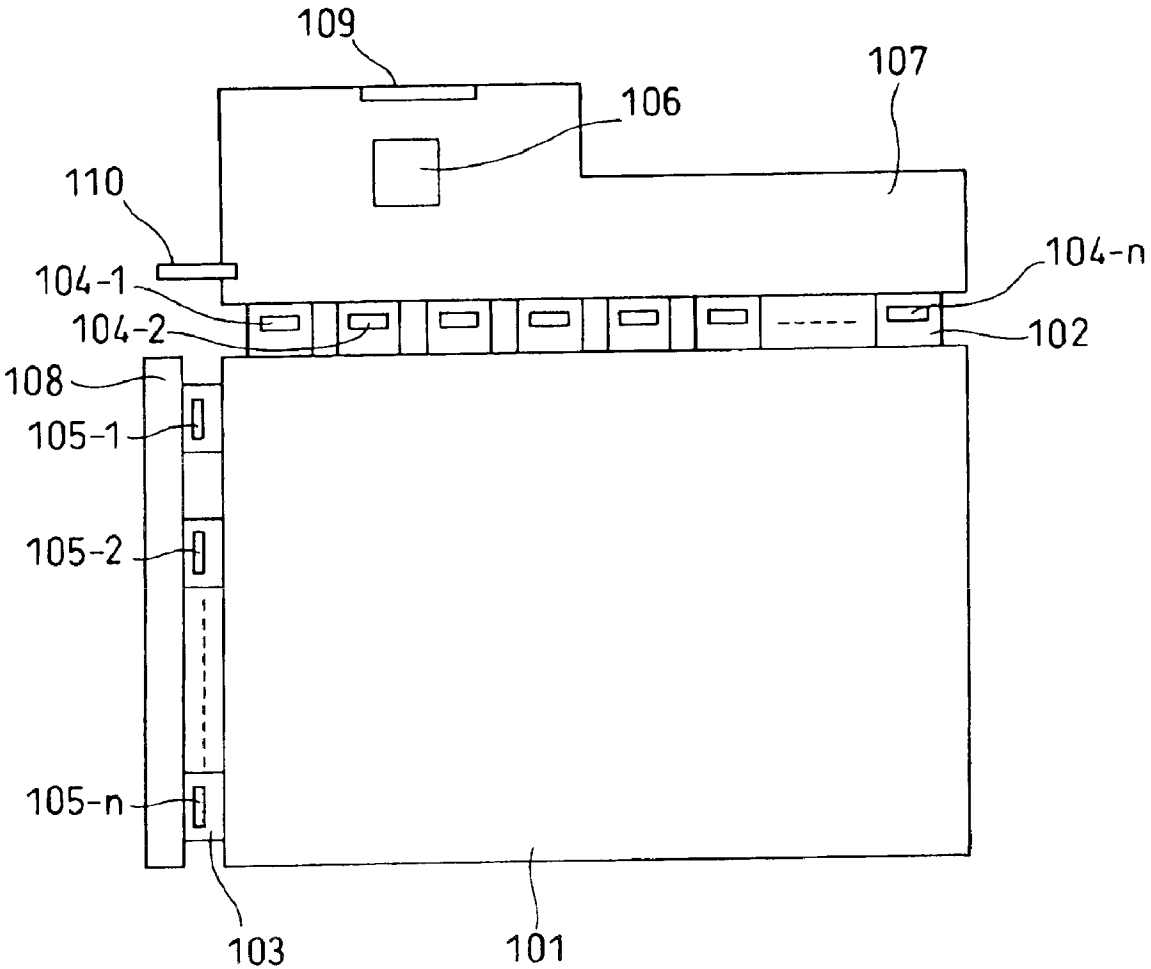
FIG. 1 (PRIOR ART)
FIG. 1 is a schematic diagram showing an overall structure of a conventional liquid crystal display apparatus.
Figure 2:
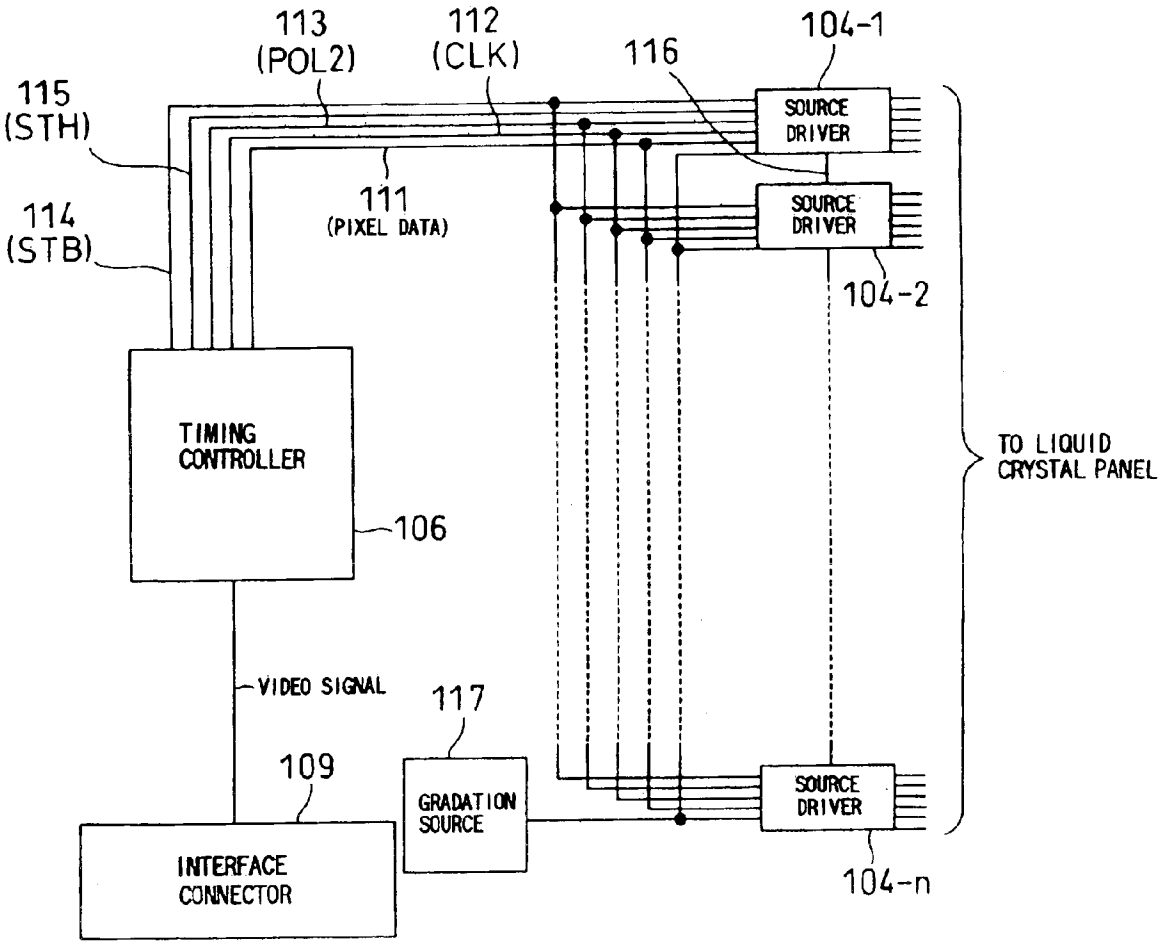
FIG. 2 (PRIOR ART)
FIG. 2 is a block diagram showing a relationship between source drivers and a timing controller and the like in a conventional liquid crystal display apparatus.
Figure 3:
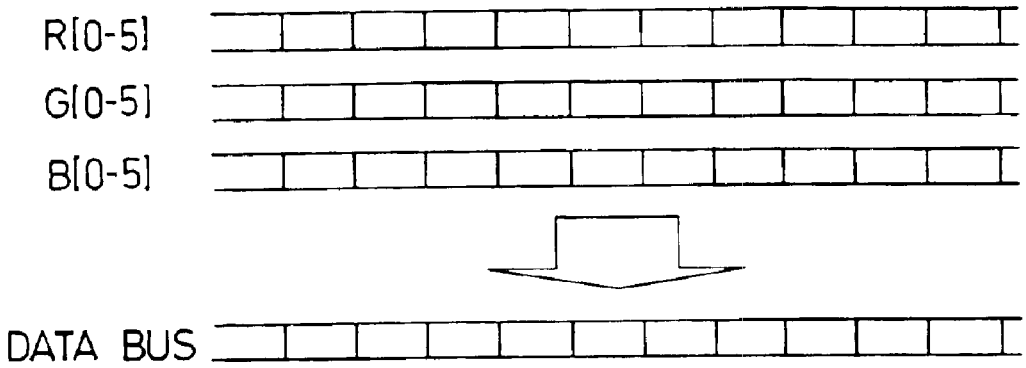
FIG. 3 (PRIOR ART)
FIG. 3 is a schematic diagram showing a relationship between data buses and data lines.

According to the embodiment, as shown in FIG. 9, an interface connector 9 is connected with a timing controller 6, and a video signal is transmitted to the timing controller 6 from the interface connector 9. Further, n pieces of source drivers 4-1 through **4-*n* are connected to the timing controller 6 through a data bus group 11, a clock signal line 12 and a data latch signal line 14. While comprised of two data buses for instance here, the data bus group 11 may be comprised of four or more data buses, for example, depending on the frequency of a clock signal. Where the data bus group 11 is comprised of two data buses, transmitted to one of the data buses are pixel data which are supplied to pixels located at odd-numbered lines counting from the gate line which is at one end and transmitted to the other data bus are pixel data which are supplied to pixels located at even-numbered lines. Each data bus, when pixel data are a digital signal of six bits, is formed by six data lines each for red, green and blue as shown in FIG. 3, and therefore, where the data bus group 11 is comprised of two data buses as described above, there are thirty-six data lines existing between the timing controller 6** and each source driver. If pixel data are an 8-bit digital signal, each data bus is formed by twenty-four data lines.

A clock signal CLK is supplied to each source driver on the clock signal line 12, and a data latch signal STB is supplied to each source driver on the data latch signal line 14. Further, a shift/inversion signal line 15 is connected between the timing controller 6 and each source driver. A cascade signal line 16 is connected between the adjacent source drivers. A shift signal STH outputted from the timing controller 6 is supplied directly to the first-stage source driver 4-1, while each one of the source drivers 4-2 through **4-*n* receives on the cascade signal line 16 the shift signal STH which is outputted from the immediately preceding source driver, as shown in FIG. 10. An inversion signal POL2 is supplied from the timing controller 6** directly to each source driver.

In addition, a gradation level power source 17 which supplies a gradation level voltage to each source driver is disposed in the liquid crystal display apparatus according to the embodiment.

Figure 4:
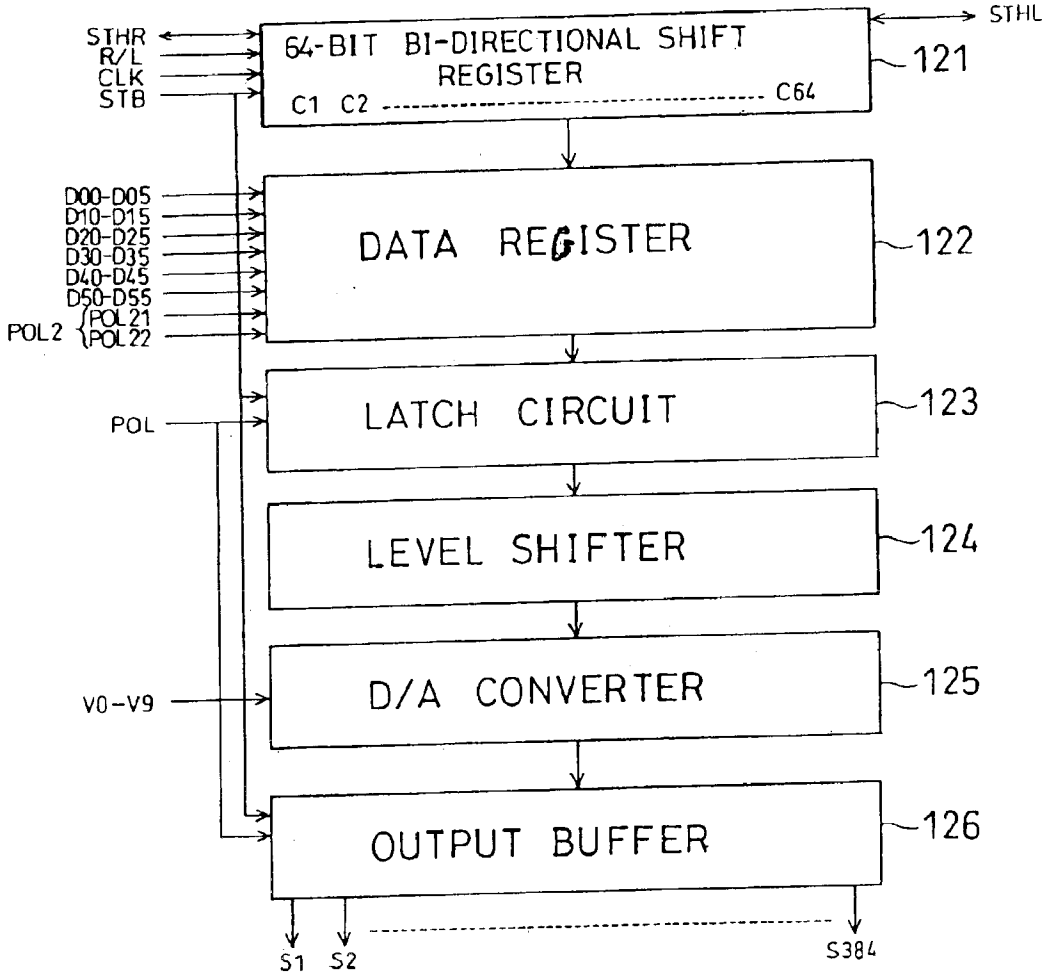
FIG. 4 (PRIOR ART)
FIG. 4 is a block diagram of a conventional source driver.
Figure 5:
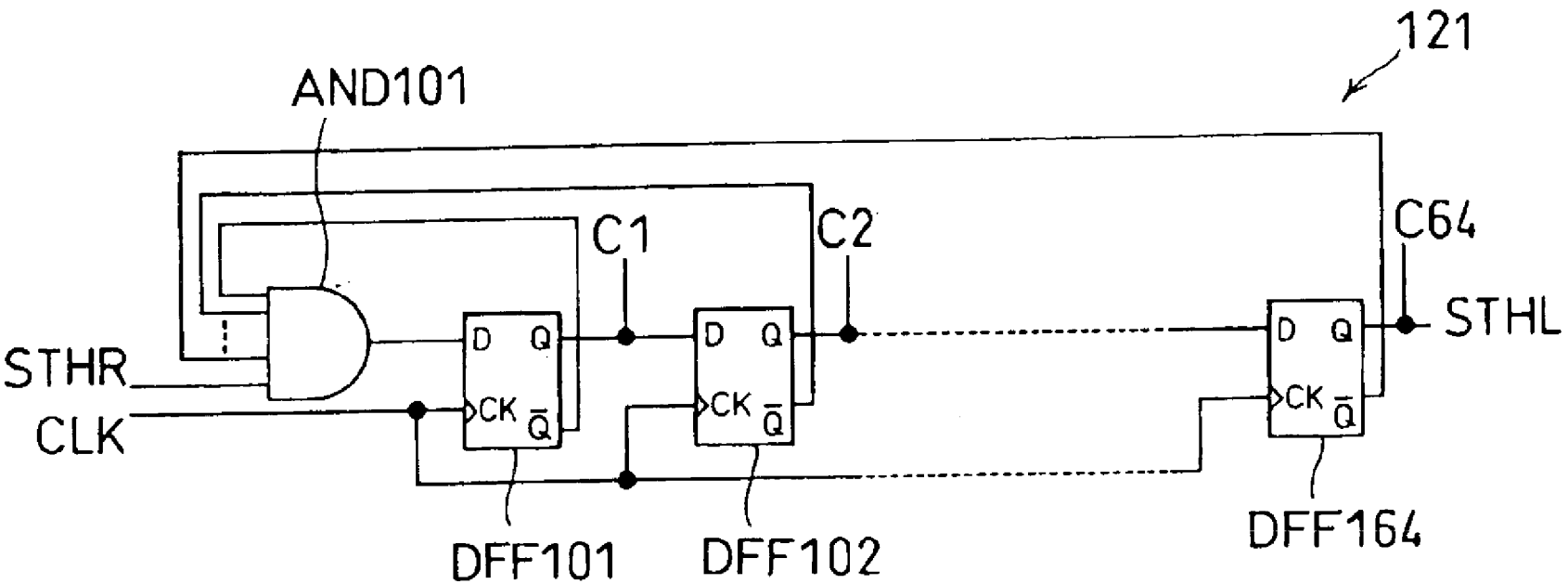
FIG. 5 (PRIOR ART)
FIG. 5 is a circuitry diagram of a conventional shift register.
Figure 6:
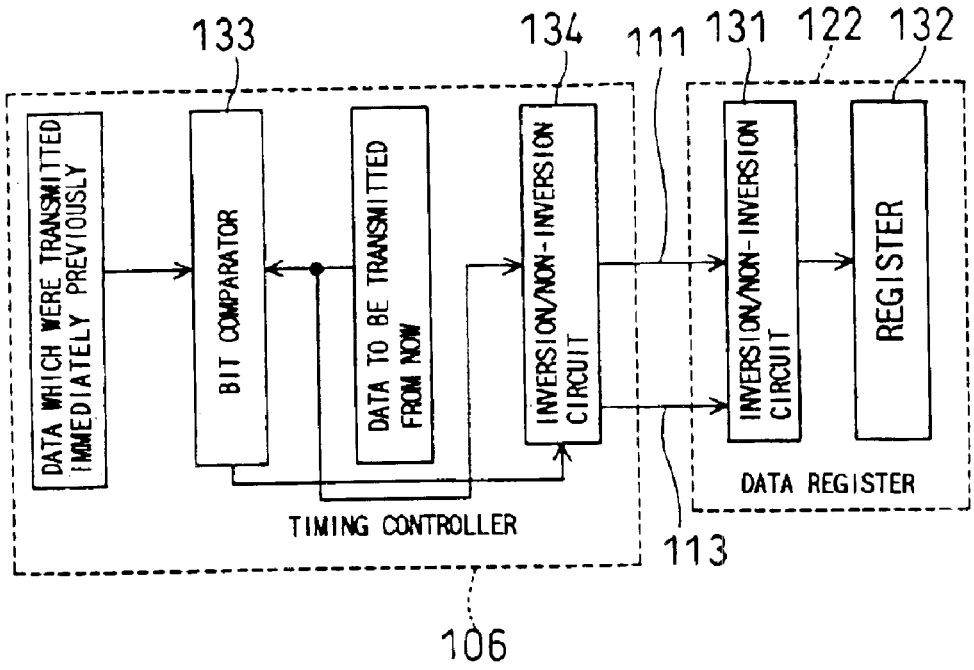
FIG. 6 (PRIOR ART)
FIG. 6 is a block diagram showing a relationship between a conventional data register and a timing controller.
Figure 7:
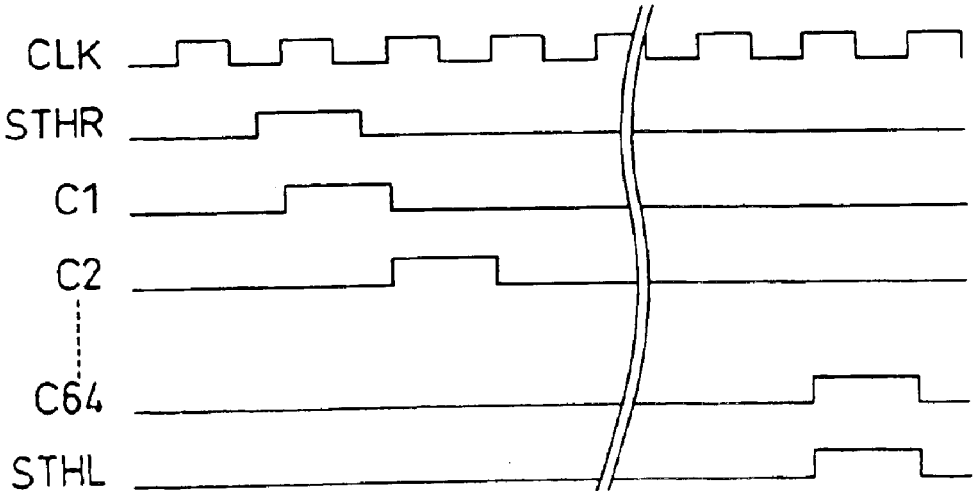
FIG. 7 (PRIOR ART)
FIG. 7 is a timing chart showing an operation of a conventional shift register 121.
Figure 8A:
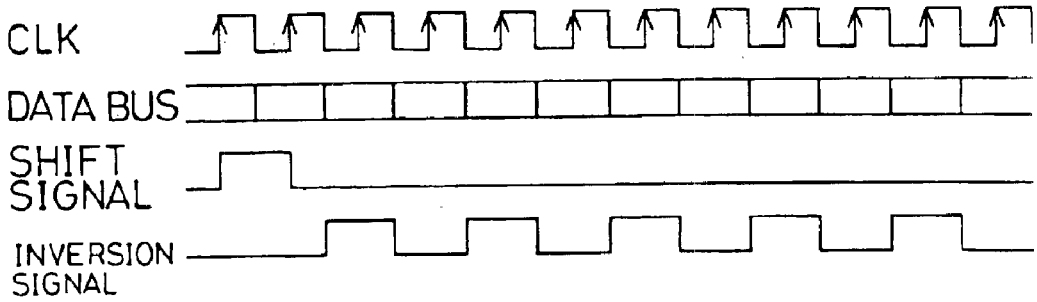
FIG. 8A (PRIOR ART)
FIGS. 8A, 8B and 8C are timing charts showing a method of driving a conventional liquid crystal display apparatus.
Figure 8B:
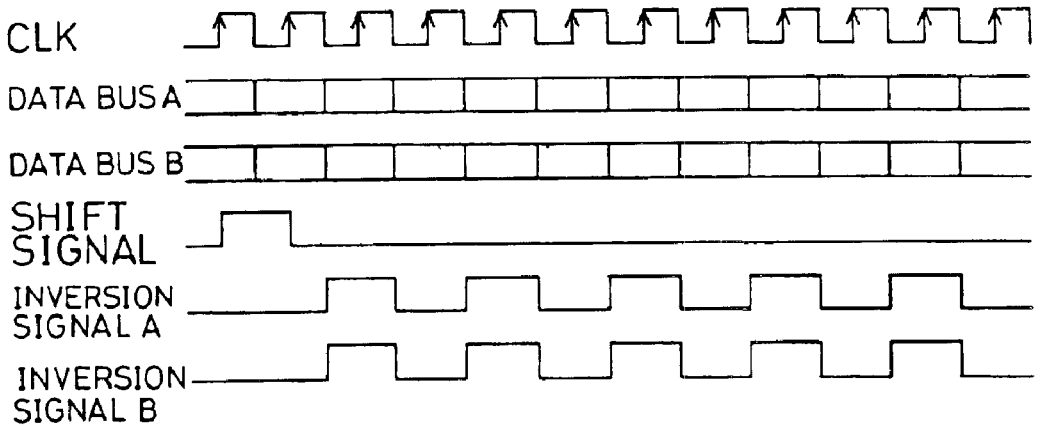
FIG. 8B (PRIOR ART)
Figure 8C:
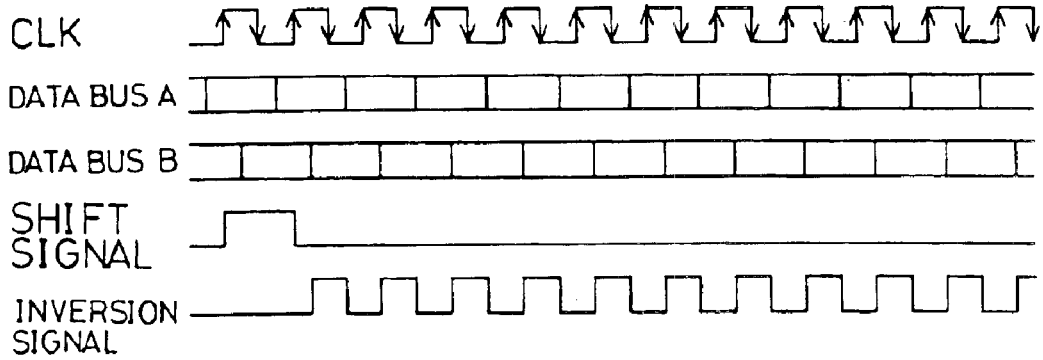
FIG. 8C (PRIOR ART)

Except for the structure of a shift register which is disposed inside for instance, each one of the source drivers 4-1 through 4-*n* has a similar structure to that of the conventional source drivers which are shown in FIG. 4. A 64-bit bi-directional shift register 21 disposed in each source driver according to the embodiment comprises sixty-four D-type flip flops DFF1 through DFF64 which are directly connected with each other, as shown in FIG. 11. The clock signal CLK is supplied to a CK-terminal for each one of the D-type flip flops DFF1 through DFF64. In the case where a terminal STHL is to serve as an input terminal for the shift signal STH, an output signal from a logical multiplication gate AND1 is fed to a D-terminal of the first-stage D-type flip flop DFF1. Meanwhile, a QB-terminal for each one of the D-type flip flops DFF1 through DFF63 is connected to an input terminal of the logical multiplication gate AND1. Further, there is an SR-type flip flop SRFF1 whose S-terminal receives the shift signal STH and whose R-terminal receives the data latch signal STB. An output signal from the SR-type flip flop SRFF1 is supplied to one input terminal of the logical multiplication gate AND1. In the first-stage source driver 4-1, a signal received at the S-terminal of the SR-type flip flop SRFF1 is a signal which is a superimposition of the shift signal STH and the inversion signal POL2 (hereinafter referred to as a "superimposed signal"). Further, an OR gate OR1 for obtaining the logical addition of the shift signal STH and the inversion signal POL2 is also disposed. The signals fed as the inversion signal POL2 to the respective source drivers 4-1 through 4-*n* are, in reality, superimposed signals.

The 64-bit bi-directional shift register 21 comprises an SR-type flip flop SRFF3 whose S-terminal is connected with the Q-terminal of the D-type flip flop DFF1 and whose R-terminal receives the data latch signal STB, and an SR-type flip flop SRFF2 whose S-terminal is connected with the Q-terminal of the D-type flip flop DPF64 and whose R-terminal receives the data latch signal STB. In addition, the 64-bit bi-directional shift register 21 comprises a logical multiplication gate AND2 which yields the logical multiplication of an output from the OR gate OR1 and a Q-output from the SR-type flip flop SRFF3. A QB-output from the SR-type flip flop SRFF2 is supplied to one input terminal of the logical multiplication gate AND1. The SR-type flip flop SRFF1, the OR gate OR1, the SR-type flip flop SRFF3 and the logical multiplication gate AND2 form a filter circuit 22 which serves as separation means for separating from the shift signal STH and the inversion signal POL2, an inversion signal intPOL2 which is necessary for the data register of the associated source driver and a start pulse which is needed to generate a timing pulse.

In the 64-bit bi-directional shift register 21 having such a structure, when the terminal STHL serves as the input terminal for the shift signal STH, the Q-outputs from the D-type flip flops DDF are fed as a cascade signal from the terminal STHR to the 64-bit bi-directional shift register 21 which is disposed in the subsequent-stage source driver. Further, the Q-outputs from the D-type flip flops DFF1 through DFF64 are each supplied as a timing pulse from the terminals C1 through C64 to the data register of the associated source driver. In addition, an output signal from the logical multiplication gate AND2 is supplied to the data register of this source driver as the inversion signal intPOL2. The inversion signal intPOL2 corresponds to the two data buses which form the data bus group, and is separated in accordance with rising/falling of the clock signal into inversion signals intPOL21 and intPOL22 which correspond to the data buses.

The liquid crystal display apparatus according to the embodiment is otherwise similar to the conventional structure. For example, comparison is made on pixel data outputted to the data bus group 11 from the timing controller 6 to determine how many bits of change has been created as compared to pixel data which were outputted immediately previously, and in the event that half or more bits of the pixel data has changed, the pixel data are inverted and outputted, the active inversion signal POL2 is outputted together, the pixel data are inverted once again within the data register based on the inversion signal intPOL2, and pixel data which are the same as the original pixel data are stored in the register.

Figure 12:
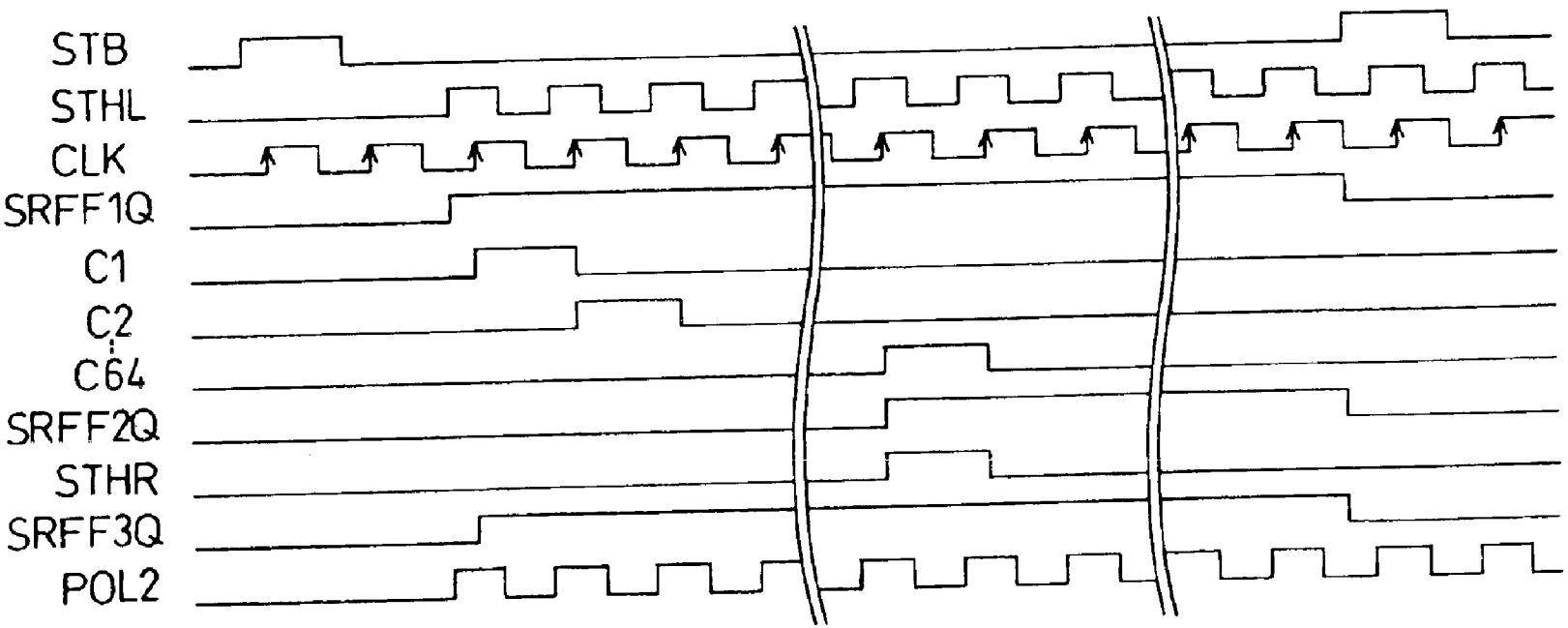
FIG. 12 is a timing chart showing an operation of the shift register in the embodiment of the present invention.
Figure 13:
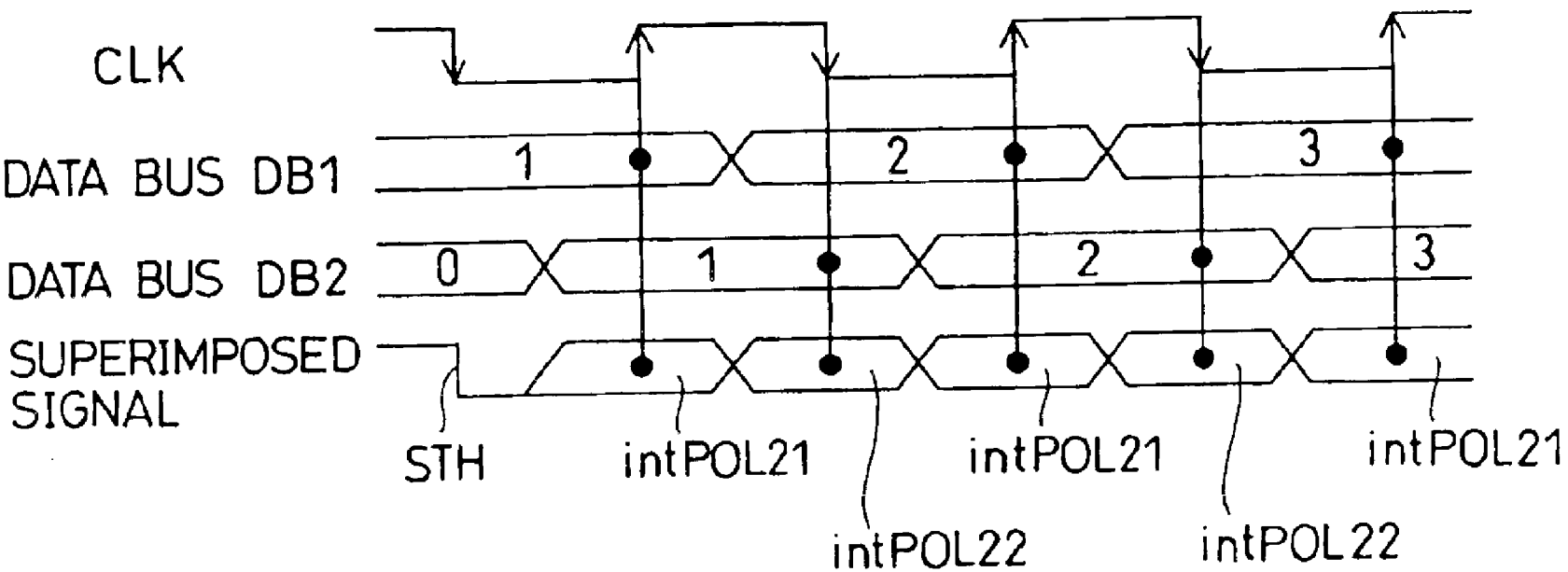
FIG. 13 is a timing chart showing an operation of a data register in the embodiment of the present invention.

An operation of the liquid crystal display apparatus having such a structure above according to the embodiment will now be described. FIG. 12 is a timing chart showing an operation of the shift register in the embodiment of the present invention, and FIG. 13 is a timing chart showing an operation of the data register in the embodiment of the present invention. In FIG. 13, of the two data buses which form the data bus group 11, the data bus DB1 is the one which receives pixel data supplied to the source lines located at the odd-numbered source lines counting from the outermost gate line on the gate driver side, whereas the data bus DB2 is the one which receives pixel data supplied to the source lines located at the even-numbered source lines. Of the inversion signals intPOL21 and intPOL22 contained in the inversion signal intPOL2, the one corresponding to the data bus DB1 is intPOL21 while the one corresponding to the data bus DB2 is intPOL22.

In this embodiment, first, immediately before outputting of effective pixel data, the timing controller 6 outputs the shift signal STH as a start pulse to the source driver 4-1 on the shift/inversion signal line 15. In the shift register 21 disposed in the source driver 4-1, the SR-type flip flop SRFF1 activates a flag upon receipt of the start pulse. This makes it possible to load the pixel data into the source driver 4-1. Further, like the conventional timing controller, the timing controller 6 inverts the pixel data via the data bus group 11 in accordance with the amount of change in the pixel data or transmits the pixel data without inverting the pixel data, and when inverted the pixel data, outputs the active inversion signal POL2 to the source driver 4-1 on the shift/inversion signal line 15.

The shift register 21 disposed in the source driver 4-1 outputs at the terminal C1 to the data register a timing pulse which is active only for one clock in synchronization with the first rise in the clock CLK after the shift signal STH is received as the start pulse, and thereafter outputs timing pulses at terminals C2 through C64 one after another to the data register. The SR-type flip flop SRFF3 activates a flag in response to the Q-output from the D-type flip flop DFF1 and the logical multiplication gate AND2 yields the logical multiplication of this Q-output and the superimposed signal, whereby the inversion signal intPOL2 is generated. In response to a rise in the Q-output from the last-stage D-type flip flop DFF64, the shift signal STH which is shifted as the cascade signal to the subsequent-stage source driver 4-2 rises on the cascade signal line 16.

The data register disposed in the source driver 4-1, referring to the timing pulses outputted at the terminals C1 through C64, stores the pixel data in a similar manner to that of conventional data registers. At this stage, in this embodiment, as shown in FIG. 12, the pixel data on the data bus DB1 are stored upon rising of the clock signal CLK while the pixel data on the data bus DB2 are stored upon falling of the clock signal CLK. Since the inversion/non-inversion circuit disposed in the data register cannot directly accept the inversion signal POL2 outputted from the timing controller 6, the pixel data are inverted when appropriately based on the inversion signal intPOL2 which is generated by the shift register 21.

In the case where pixel data are an 8-bit digital signal for instance, when data to be transmitted from the timing controller 6 from now are FF(h) and data which were transmitted immediately previously are 00(h), since the amount of change in bits is eight bits which are a majority or more, the timing controller 6 transmits the active inversion signal POL2 and the pixel data 00(h) which are obtained by inverting FF(h). The data register accordingly receives the pixel data 00(h) and the active inversion signal intPOL2 and stores the pixel data FF(h) which are the inversion of 00(h).

This is followed by processing performed by a latch circuit, a level shifter, a D/A converter and an output buffer in a similar manner to the conventional manner.

In the source driver 4-2, the SR-type flip flop SRFF1 of the shift register 21 disposed within the source driver 4-2 activates a flag upon rising of the Q-output from the D-type flip flop DFF64 which is disposed in the shift register 21 of the source driver 4-1, so that the image data are stored in a similar manner to that in the source driver 4-1. Further, similar processing takes place in the subsequent-stage source drivers 4-3 through **4-*n***.

After processing in the n pieces of the source drivers 4-1 through **4-*n* is completed and the gradation level voltages (analog) are supplied to the source lines of the liquid crystal panel, the data latch signal STB is activated and the SR-type flip flops SRFF1 through SRFF3 which are disposed in the respective shift registers 21** are reset.

Since the start pulse and the inversion signal are transmitted to the source driver 4-1 on the one shift/inversion signal line 15 in the liquid crystal display apparatus as described above according to the embodiment, an increase in the number of signal lines associated with the transfer speed is suppressed.

The number of bits in pixel data, the number of bits in the registers and the like may be appropriately modified in accordance with the resolution and the like of the liquid crystal panel, and are not limited to those described in relation to the embodiment above.

The present invention is not limited to liquid crystal display apparatuses but may be applied to plasma displays and organic EL displays for example.

Further, the type of flip flops which forms the shift registers is not limited to the D-type but may be another type.

Alternatively, the inversion signal transmitted on the same signal line as the shift signal does not need to correspond to the two data buses. An inversion signal which corresponds to only one data bus may be transmitted on the same signal line.

As described in detail above, according to the present invention, since the start pulse and the inversion signal are transmitted on the same signal line to the drive circuit which is connected to one end, even where there are a plurality of data buses to which a video signal is transmitted, an increase in the number of signal lines is suppressed. This allows to suppress an increase in the number of pins of an LSI package. Further, since the gaps between the signal lines can be wide, it is possible to reduce parasitic capacitance and accordingly suppress cross talk due to the influence by mutual inductance and capacitance. In addition, as an increase in the number of signal lines is suppressed, it is possible to reduce the number of design steps.

What is claimed is:

1. An image display apparatus, which comprises:

a display panel;

a plurality of drive circuits which drive said display panel and are connected to each other; and a timing controller connected by a data bus group and a shift/inversion signal line to each of said drive circuits, said timing controller transmitting plural consecutive video signals over said data bus group to said drive circuits, said timing controller following a first, non-inverted video signal with a consecutive second, inverted video signal, the first video signal transmitted as a digital signal to said plurality of drive circuits while transmitting a start pulse, over the shift/inversion signal line instructing to start reading said first video signal to one of said plurality of drive circuits, said timing controller transmitting the inverted video signal to said drive circuits when the amount of digital signal change between two consecutive video signals reaches or exceeds a predetermined value while transmitting an inversion signal, over the shift/inversion signal line indicating that the inverted video signal is being transmitted to said drive circuits, said start pulse and said inversion signal being transmitted to said one drive circuit via said shift/inversion signal line.

2. The image display apparatus according to claim 1, wherein said drive circuits comprise a data register which stores said video signal and a shift register which is instructed as to the timing of storing said video signal, and said shift register comprises separation means which separates said start pulse from said inversion signal.

3. The image display apparatus according to claim 2, wherein when said inversion signal separated by said separation means is active, said data register inverts said video signal transmitted from said timing controller and stores this video signal.

4. The image display apparatus according to claim 1, wherein said start pulse is sequentially shifted among said plurality of drive circuits.

5. The image display apparatus according to claim 2, wherein said start pulse is sequentially shifted among said plurality of drive circuits.

6. The image display apparatus according to claim 3, wherein said start pulse is sequentially shifted among said plurality of drive circuits.

7. The image display apparatus according to claim 1, wherein said data bus group is comprised of two data buses, transmitted to a first of the two data buses are pixel data which are supplied to pixels located at odd-numbered lines of the display panel and transmitted to a second of the two data buses are pixel data which are supplied to pixels located at even-numbered lines.

8. The image display apparatus according to claim 2, wherein said data bus group is comprised of two data buses.

9. The image display apparatus according to claim 3, wherein said data bus group is comprised of two data buses.

10. The image display apparatus according to claim 1, wherein said display panel is a liquid crystal panel.

11. The image display apparatus according to claim 2, wherein said display panel is a liquid crystal panel.

12. The image display apparatus according to claim 3, wherein said display panel is a liquid crystal panel.

13. An image display apparatus, which comprises:

a display panel;

a plurality of drive circuits which drive said display panel and are connected to each other; and a timing controller connected by a data bus group and a shift/inversion signal line to each of said drive circuits, said timing controller transmitting plural consecutive video signals over said data bus group to said drive circuits, said timing controller following a first, non-inverted video signal with a consecutive second, inverted video signal, the first video signal transmitted as a digital signal to said plurality of drive circuits while transmitting a start pulse, over the shift/inversion signal line instructing to start reading said first video signal to one of said plurality of drive circuits, said timing controller transmitting the inverted video signal to said drive circuits when the amount of digital signal change between two consecutive video signals reaches or exceeds a predetermined value while transmitting an inversion signal, over the shift/inversion signal line indicating that the inverted video signal is being transmitted to said drive circuits, wherein said drive circuits comprise a data register which stores said video signal and a shift register which is instructed as to the timing of storing said video signal, and said shift register comprises separation means which separates said start pulse from said inversion signal.

14. The image display apparatus according to claim 13, wherein when said inversion signal separated by said separation means is active, said data register inverts said video signal transmitted from said timing controller and stores this video signal.

15. The image display apparatus according to claim 13, wherein said start pulse is sequentially shifted among said plurality of drive circuits.

16. The image display apparatus according to claim 13, wherein said data bus group is comprised of two data buses, transmitted to a first of the two data buses are pixel data which are supplied to pixels located at odd-numbered lines of the display panel and transmitted to a second of the two data buses are pixel data which are supplied to pixels located at even-numbered lines.

17. The image display apparatus according to claim 13, wherein said data bus group is comprised of two data buses.

18. The image display apparatus according to claim 13, wherein said display panel is a liquid crystal panel.

19. An image display apparatus, which comprises:

a display panel;

a plurality of drive circuits connected to each other to drive said display panel; and a timing controller;

a data bus group and a shift/inversion signal line connecting the timing controller to each of said drive circuits, said timing controller transmitting plural consecutive video signals over said data bus group to said drive circuits, said timing controller following a first, non-inverted video signal with a consecutive second, inverted video signal, the first video signal transmitted as a digital signal to said plurality of drive circuits while transmitting a start pulse, over the shift/inversion signal line instructing to start reading said first video signal to one of said plurality of drive circuits, said timing controller transmitting the inverted video signal to said drive circuits when the amount of digital signal change between two consecutive video signals reaches or exceeds a predetermined value while transmitting an inversion signal, over the shift/inversion signal line indicating that the inverted video signal is being transmitted to said drive circuits, wherein said drive circuits comprise a data register which stores said video signal and a shift register which comprises separation means which separates said start pulse from said inversion signal, providing a separated start pulse and a separated inversion signal as output signals of the shift register.

20. The display apparatus of claim 19, wherein the separated start pulse from the shift register of each drive circuit is input to the shift register of a next drive circuit as the start signal for the next drive circuit.

* * * * *